United States Patent [19]

Janberg et al.

[11] Patent Number: 4,495,139

[45] Date of Patent: Jan. 22, 1985

[54] RADIOACTIVE-WASTE CONTAINER WITH LEAK MONITOR

[75] Inventors: Klaus G. Janberg, Ratingen-Lintorf; Dieter Methling, Hattingen, both of Fed. Rep. of Germany

[73] Assignee: GNS Gesellschaft fur Nuklear-Service mbH, Essen, Fed. Rep. of Germany

[21] Appl. No.: 396,769

[22] Filed: Jul. 9, 1982

[30] Foreign Application Priority Data

Jul. 10, 1981 [DE] Fed. Rep. of Germany ..... 3127219

[51] Int. Cl.[3] ..... G21C 17/00

[52] U.S. Cl. ..... 376/203; 376/250; 376/272; 250/506.1

[58] Field of Search ..... 376/203, 205, 250, 272; 250/507.1, 506.1

[56] References Cited

U.S. PATENT DOCUMENTS

| | | | |
|---|---|---|---|
| 3,819,478 | 6/1974 | Thorel et al. | 376/206 |
| 3,819,479 | 6/1974 | Jacquelin | 376/206 |
| 3,867,254 | 2/1975 | Brandstetter | 376/206 |
| 3,929,253 | 12/1975 | Johnsson | 376/205 |
| 4,076,585 | 2/1978 | Cachera | 376/250 |
| 4,236,971 | 12/1980 | Winkleblack | 376/206 |
| 4,353,391 | 10/1982 | Belmonte et al. | 376/272 |

*Primary Examiner*—Sal Cangialosi

*Attorney, Agent, or Firm*—Karl F. Ross; Herbert Dubno

[57] ABSTRACT

A container has a massive metallic vessel whose interior is adapted to receive radioactive waste and whose mouth is formed with inner and outer spaced generally planar and annular vessel shoulders and formed therebetween with a nonplanar intermediate annular vessel surface. A massive metallic cover formed with a plug fits in the mouth and has respective inner and outer plug shoulders closely juxtaposed with the vessel shoulders and a nonplanar intermediate annular plug surface complementary to the intermediate vessel surface. An inner ring seal engages snugly between the inner shoulders. A pair of generally concentric and spaced outer ring seals engage snugly between the outer shoulders and forming an annular outer chamber therebetween. An intermediate ring seal engages snugly between the intermediate surfaces and forms therebetween and with the inner ring seal an annular inner chamber and therebetween and with the outer ring seals an intermediate chamber. The cover is formed with respective inner, intermediate, and outer passages each having one end opening into the respective chamber and another end. Valves are provided on the cover at the other ends of the passages for sampling gases therein and in the respective chambers.

10 Claims, 1 Drawing Figure

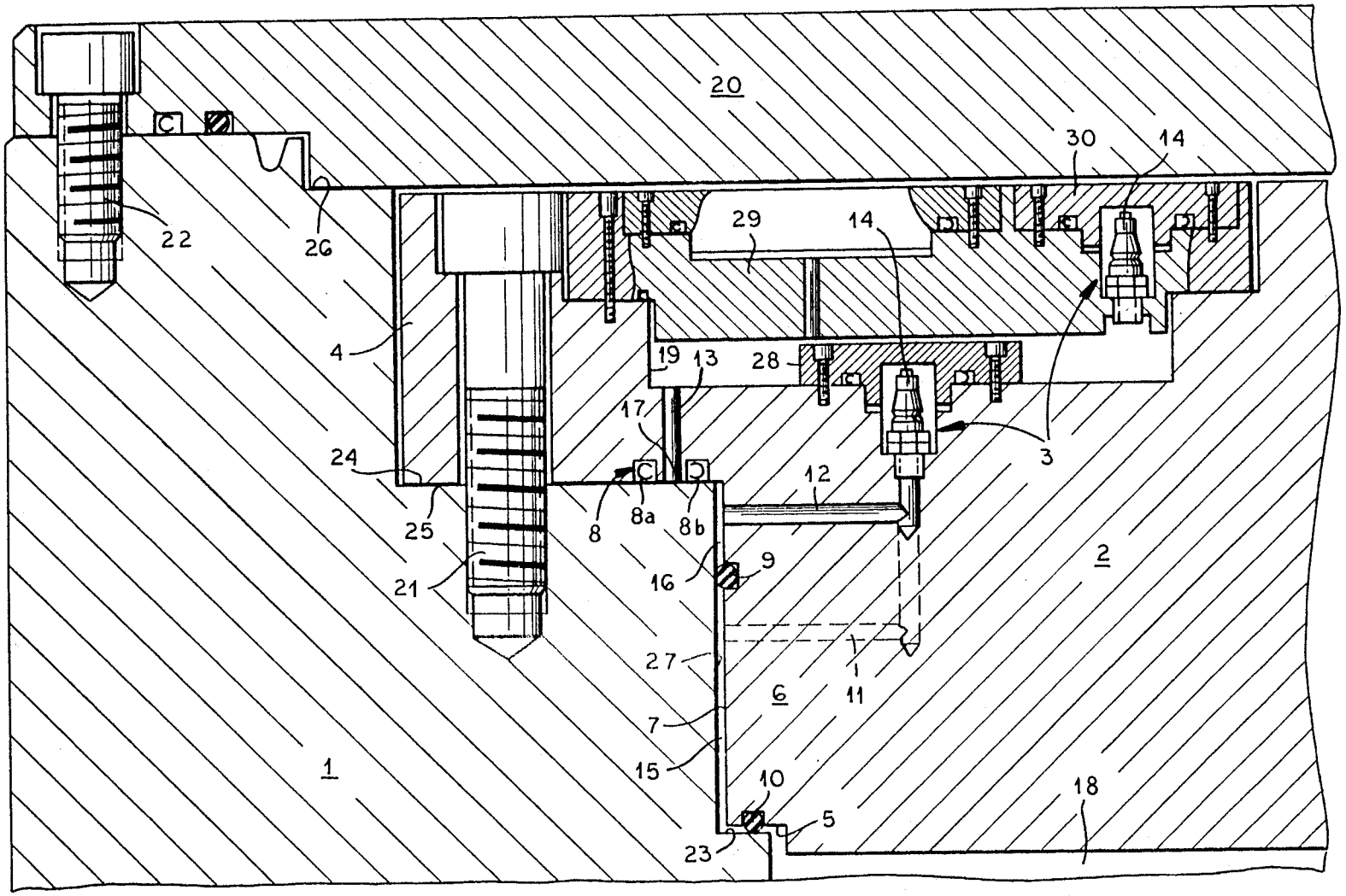
14
30
3
2
18
14
11
12
5
20
29
28
6
10
9
13
8b
23
19
17
8a
16
27
7
15
8
25
21
4
24
1
26
22

RADIOACTIVE-WASTE CONTAINER WITH LEAK MONITOR

FIELD OF THE INVENTION

The present invention relates to a container for the storage and shipment of radioactive waste such as spent nuclear-reactor fuel rods. More particularly this invention concerns such a container which is provided with means for monitoring leakage from its interior.

BACKGROUND OF THE INVENTION

It is standard practice to ship and store spent nuclear-reactor fuel rods in large metallic containers formed normally of vessels and covers both made of spherulitic cast iron or even steel. Such a container is quite large, having wall thickness of 0.2 m to 0.6 m and an overall height of several meters. The vessel can be made as described in copending patent application Ser. No. 379,890 filed 5/1982 of Friedrich Werner, and may have inclusions of shielding metal such as lead or even lead bars imbedded in its walls.

The cover of such a container is formed with a plug that fits within the mouth of the vessel. For best sealing action the vessel mouth and plug are complementarily formed with at least one interfitting shoulder bordered by an annular nonplanar—usually cylindrical or frustoconical—surface. Seals, typically O-rings, are set in the confronting surfaces to form several seal barriers. Typically the material inside is stabilized by concrete, but even so radioactive material is quite active. In fact the vessels are often formed with cooling fins for the figuratively and literally hot contents.

In order to monitor whether any of the seals has failed, German patent document No. 2,905,094 filed Feb. 10, 1979 with no priority claim by Henning Baatz proposes a system wherein the vessel is formed with several passages that open between the seals. Such a vessel can be pressurized with a tracer gas, or the chambers themselves can be thus pressurized. In this manner a sniffer connected to the other end of any of these passages can detect the presence or absence of this tracer gas as well as any leaked radioactivity. In addition a pressure reading of each of these chambers can often provide valuable information.

To this end the upper rim of the vessel is formed with recesses in which the valves for the other ends of the passages open. Thus this rim must be provided with a safety cover to protect these elements. The provision of this extra cover, normally in addition to the above-described cover and a so-called second safety cover overlying it, represents an noticeable manufacturing expense. In addition the passages in the vessel, which may weigh over a ton empty, must be made in situ, that is they cannot be easily conveyed to a shop. This again adds to costs.

OBJECTS OF THE INVENTION

It is therefore an object of the present invention to provide an improved radioactive-waste container.

Another object is the provision of such a radioactive-waste container which overcomes the above-given disadvantages.

A further object is to provide an inexpensive such container which is provided with a superior leak monitor.

SUMMARY OF THE INVENTION

These objects are attained according to the instant invention in a container whose massive metallic vessel, much as in the prior art, has an interior adapted to receive radioactive waste and a mouth formed with inner and outer spaced generally planar and annular vessel shoulders and formed therebetween with a nonplanar intermediate annular vessel surface. A massive metallic cover formed with a plug fits in the mouth and has respective inner and outer plug shoulers closely juxtaposed with the vessel shoulders and a nonplanar intermediate annular plug surface complementary to the intermediate vessel surface. An inner ring seal engages snugly between the inner shoulders. A pair of generally concentric and spaced outer ring seals engage snugly between the outer shoulders and forming an annular outer chamber therebetween. An intermediate ring seal engages snugly between the intermediate surfaces and forms therebetween and with the inner ring seal an annular inner chamber and therebetween and with the outer ring seals an intermediate chamber. The cover is formed with respective inner, intermediate, and outer passages each having one end opening into the respective chamber and another end. Means is provided on the cover at the other ends of the passages for sampling gases therein and in the respective chambers.

Thus with the system of this invention the relatively small cover is formed with the passages and is provided with the monitoring means. In fact according to another feature of this invention all the seal rings, which may be of any standard elastic or metallic construction, are received in respective grooves in the cover.

The provision of a third chamber on the shoulder at the flange of the cover eliminates the necessity of an additional hermetically tight cover to form an outermost chamber for monitoring leaks. A simple cover serving only to prevent physical damage to the covered structure is all that is needed. All of the passages terminate in respective recesses or pockets formed in the top of the cover and also covered, for safety's sake, by respective bolted-on plates. Obviously these leak monitors are not used a lot; typically they are useful in the event of an accident, such as during transport, when the integrity of the containers might be doubted.

According to another feature of this invention the covers are secured by means such as bolts to the vessel at its mouth. Such connection is inexpensive and very strong.

The shoulders according to this inventjion are planar and parallel. The intermediate surfaces are surfaces of revolution, normally cylindrical.

A body of tracer gas at above-ambient pressure in the vessel makes the system of this invention particularly easy to use to detect leaks. The gas can be in the vessel or in some or all of the chambers, and may be at different pressures in the different chambers so any leakage can be detected.

According to this invention the other passage ends are provided with valves of the one-way type, or of the type that only open when connected to an appropriate fitting. Thus leakage at this end of each passage is made impossible.

DESCRIPTION OF THE DRAWING

The above and other features and advantages will become more readily apparent from the following, reference being made to the accompanying drawing whose sole FIGURE is an axial section through a detail of a radioactive-waste container according to this invention.

SPECIFIC DESCRIPTION

As seen in the drawing a vessel 1 of spherulitic cast iron has a cover 2 of the same material. The vessel has a mouth formed with a shoulder 23 lying in a plane perpendicular to the vessel center axis, a cylindrical intermediate surface extending up from its outer periphery, and another shoulder 24 parallel to the shoulder 23. Other than these formations, some bolt holes, and a groove 26, the vessel 1 is not machined much, but can be a raw casting.

The cover 2 is basically formed of a flange part 4 and a plug part 6. The plug part 6 forms an inner shoulder 5 closely juxtaposed with and axially confronting the shoulder 23, and an intermediate cylindrical surface 7 complementary to the surface 27. The flange forms another shoulder surface 25 confronting and complemtnary to the surface 24. Bolts 21 extending through the outer regions of the flange 4 secure the cover 2 to the vessel 1.

A safety cover 21 is secured by further bolts 22 to the rim of the vessel 1 in the groove 26 and serves principally to protect the cover 2 from physical harm.

The surfaces 5 and 7 are formed with respective axially downwardly and radially outwardly open grooves receiving respective O-ring seals 10 and 9 that tightly engage the surfaces 23 and 27, and that form an annular compartment 15. The surface 24 of the flange 4 is formed with two concentric and radially spaced grooves that receive respective C-section seals **8*a* and 8*b* of an outer seal 8. The rings 8*a* and 8*b* together form an annular outer compartment 17, and the ring 8*b* forms with the ring 9 an intermediate compartment 16**.

In addition the cover 2 is formed with respective passages 11, 12, and 13 opening into the respective chambers 15, 16, and 17 and provided at their other ends with valves 14 of a monitoring means 3. The cover is formed with an axially upwardly open recess 19 in which the valve 14 of the intermediate chamber 16 opens, although normally it is covered by a cap 28. Another cover 29 closes this recess 19 for maximum protection, and the outer passage 13 of the outer chamber 17 opens directly into this recess 19, so the valve 14 in its cover 29 can be tapped to test for leaks.

Normally the interior 18 of the vessel 1 is filled with a pressurized, easily detectable tracer gas above the radioactive material in it. If this gas is detected though the monitoring means 3 in any of the chambers 15–17, the container can be refitted. In any case, the outermost chamber 17 can be sampled easily by removing the safety cover 20, then pulling the cover 30 off the valve 14 in the cover 29 and connecting up to this valve 14. If no leak is detected one can be sure that the cover 29 can be removed to sample the chambers 15 and 16. This is an extremely safe procedure.

Thus the container according to the instant invention can be made quite a bit more cheaply than the prior-art one, as all of the tricky machining is done on the relatively portable cover 2. In addition three chambers are provided in a row to test for leakage in the statutorily required failsafe manner, and all three of these chambers are formed by structure on the cover 2. These chambers can be individually sampled and/or charged at superatmospheric pressure.

We claim:

1. A container for radioactive waste, said container comprising:

a massive metallic vessel having an interior adapted to receive radioactive waste and having a mouth formed with inner and outer spaced generally planar and annular vessel shoulders and formed therebetween with a nonplanar intermediate annular vessel surface;

a massive metallic cover formed with a plug fitted in said mouth and having respective inner and outer plug shoulders closely juxtaposed with said vessel shoulders and a nonplanar intermediate annular plug surface complementary to said intermediate vessel surface;

an inner ring seal engaged snugly between said inner shoulders;

a pair of generally concentric and spaced outer ring seals engaged snugly between said outer shoulders and forming an annular outer chamber therebetween;

an intermediate ring seal engaged snugly between said intermediate surfaces and forming therebetween and with said inner ring seal an annular inner chamber and therebetween and with said outer ring seals an intermediate chamber, said cover being formed with respective inner, intermediate, and outer passages each having one end opening into the repective chamber and another end; and means on said cover at the other ends of said passages for sampling gases therein and in the respective chambers.

2. The radioactive-waste container defined in claim 1 wherein said cover has an outwardly directed surface formed with a recess into which said other ends open and in which said means are provided.

3. The radioactive-waste container defined in claim 1, further comprising a second cover overlying the first-mentioned cover and fixed to said vessel.

4. The radioactive-waste container defined in claim 1, further comprising means for securing said cover to said vessel at said mouth.

5. The radioactive-waste container defined in claim 1 wherein said shoulders are planar and parallel.

6. The radioactive-waste container defined in claim 1 wherein said intermediate surfaces are surfaces of revolution.

7. The radioactive-waste container defined in claim 6 wherein said intermediate surfaces are substantially cylindrical.

8. The radioactive-waste container defined in clain 1, further comprising a body of tracer gas at above-ambient pressure in said vessel.

9. The radioactive-waste container defined in claim 1, further comprising bolts securing said cover to said vessel.

10. The radioactive-waste container defined in claim 1 wherein said means are valves.

* * * * *